US006760925B1

(12) United States Patent
Maxwell

(10) Patent No.: US 6,760,925 B1
(45) Date of Patent: Jul. 13, 2004

(54) AIR-CONDITIONED HARDHAT

(76) Inventor: Milton L. Maxwell, 19431 Glenway Falls, Katy, TX (US) 77449

( * ) Notice: Subject to any disclaimer, the term of this patent is extended or adjusted under 35 U.S.C. 154(b) by 0 days.

(21) Appl. No.: 10/335,162

(22) Filed: Dec. 31, 2002

(51) Int. Cl.[7] ..... A42G 5/04
(52) U.S. Cl. ..... 2/171.3; 2/7
(58) Field of Search ..... 2/171.3, 7, 410, 2/422, 906; 62/259.3, 259.4

(56) References Cited

U.S. PATENT DOCUMENTS

| | | | | | |
|---|---|---|---|---|---|
| 2,335,630 | A | * | 11/1943 | Bachardy | 2/7 |
| 3,070,803 | A | * | 1/1963 | Slepicka | 2/7 |
| 3,295,522 | A | * | 1/1967 | Johnson | 128/201.23 |
| 3,353,191 | A | * | 11/1967 | Dahly | 2/171.3 |
| 3,391,407 | A | * | 7/1968 | Waters | 2/171.3 |
| 3,548,415 | A | * | 12/1970 | Waters | 2/171.3 |
| 3,881,198 | A | * | 5/1975 | Waters | 2/171.3 |
| 4,680,815 | A | * | 7/1987 | Hirsch et al. | 2/171.3 |
| 4,858,627 | A | * | 8/1989 | Netschert | 131/329 |
| 4,893,356 | A | * | 1/1990 | Waters | 2/171.3 |
| 5,197,292 | A | * | 3/1993 | McPherson | 62/56 |
| 5,425,620 | A | * | 6/1995 | Stroud | 416/63 |
| 5,469,579 | A | * | 11/1995 | Tremblay et al. | 2/7 |
| 5,561,855 | A | * | 10/1996 | McFall | 2/8 |
| 5,561,862 | A | * | 10/1996 | Flores, Sr. | 2/171.3 |
| 5,715,533 | A | * | 2/1998 | Stein | 2/7 |
| 5,810,467 | A | * | 9/1998 | Hurwitz | 362/106 |
| 6,032,291 | A | * | 3/2000 | Asenguah et al. | 2/171.3 |
| 6,122,773 | A | * | 9/2000 | Katz | 2/171.3 |

FOREIGN PATENT DOCUMENTS

| | | | | | |
|---|---|---|---|---|---|
| JP | 06173109 | A | * | 6/1994 | A42B/1/00 |

* cited by examiner

*Primary Examiner*—Rodney M. Lindsey

(57) ABSTRACT

Air-conditioned hardhats cool the wearer's head. A motor and fan are attached to the top of the interior of a hardhat to blow air over a coolant reservoir onto the wearer's head. The coolant reservoir can be filled with coolant. The bottom of the coolant reservoir comprises an atomizer, which allows the coolant to evaporatively cool the wearer's head. The motor is powered by a solar cell and/or a rechargeable battery. The rechargeable battery may be charged by a battery charger that is connected to the solar cell and can be optionally connected to an electrical outlet by a charging cord. A switch allows the user to control whether the motor is powered or not.

5 Claims, 2 Drawing Sheets

AIR-CONDITIONED HARDHAT

BACKGROUND OF THE INVENTION

1. Field of the Invention

The present invention relates to an air-conditioned hardhat for use in connection with protective headgear. The air-conditioned hardhat has particular utility in connection with cooling the wearer's head.

2. Description of the Prior Art

Air-conditioned hardhats are desirable for cooling the wearer's head. Workers are frequently required to wear hardhats for safety reasons regardless of ambient temperature conditions. When the ambient temperature is high, hardhats can become quite uncomfortable and excessive perspiration can result. Under extreme conditions, a risk of heatstroke exists. Air-conditioned hardhats cool the wearer's head, thereby increasing the wearer's comfort level and decreasing the wearer's perspiration.

The use of headgear is known in the prior art. For example, U.S. Pat. No. 5,715,533 to Stein discloses headgear. However, the Stein '533 patent does not have a fan, and has further drawbacks of lacking a solar cell.

U.S. Pat. No. 4,893,356 to Waters discloses air-conditioned headwear having convertible power module that cools the wearer's head. However, the Waters '356 patent does not have a battery charger, and additionally does not have a coolant reservoir with an atomizer.

Similarly, U.S. Pat. No. 4,309,774 to Guzowski discloses a ventilating helmet that moves air onto the wearer's face to deter perspiring of the wearer. However, the Guzowski '774 patent does not have a coolant reservoir with an atomizer, and cannot charge a battery.

In addition, U.S. Pat. No. 3,548,415 to Waters discloses an air-conditioned helmet that provides conditioned air, either cooling or heating, to the head, neck, and shoulders of the wearer. However, the Waters '415 patent does not have a solar cell, and also does not have a battery charger.

Furthermore, U.S. Pat. No. 4,680,815 to Hirsch et al. discloses a solar powered headwear fan that is a self-contained personal cooling device. However, the Hirsch et al. '815 patent does not have a coolant reservoir with an atomizer, and further lacks a battery charger.

U.S. Pat. No. 6,122,773 to Katz discloses a ventilated hardhat that keeps the head of a wearer cool and ventilated. However, the Katz '773 patent does not have a solar cell, and has the additional deficiency of lacking a battery charger.

Lastly, U.S. Pat. No. Des. 275,334 Pullin discloses a hardhat with solar-powered cooling means that has a fan attached to the top of the hardhat. However, the Pullin '334 patent does not have a battery charger, and also does not have a coolant reservoir with an atomizer.

While the above-described devices fulfill their respective, particular objectives and requirements, the aforementioned patents do not describe an air-conditioned hardhat that allows cooling the wearer's head. The Stein '533 patent makes no provision for a fan. The Stein '533 patent, the Waters '415 patent, and the Katz '773 patent lack a solar cell. The Waters '356 patent, the Guzowski '774 patent, the Waters '415 patent, the Hirsch et al. '815 patent, the Katz '773 patent, and the Pullin '334 patent do not have a battery charger. The Waters '356 patent, the Guzowski '774 patent, the Hirsch et al. '815 patent, and the Pullin '334 patent do not have a coolant reservoir with an atomizer.

Therefore, a need exists for a new and improved air-conditioned hardhat that can be used for cooling the wearer's head. In this regard, the present invention substantially fulfills this need. In this respect, the air-conditioned hardhat according to the present invention substantially departs from the conventional concepts and designs of the prior art, and in doing so provides an apparatus primarily developed for the purpose of cooling the wearer's head.

SUMMARY OF THE INVENTION

In view of the foregoing disadvantages inherent in the known types of headgear now present in the prior art, the present invention provides an improved air-conditioned hardhat, and overcomes the above-mentioned disadvantages and drawbacks of the prior art. As such, the general purpose of the present invention, which will be described subsequently in greater detail, is to provide a new and improved air-conditioned hardhat which has all the advantages of the prior art mentioned heretofore and many novel features that result in an air-conditioned hardhat which is not anticipated, rendered obvious, suggested, or even implied by the prior art, either alone or in any combination thereof.

To attain this, the present invention essentially comprises a hardhat with a power supply attached to its exterior. A motor wire connects a motor to the power supply. A fan is rotatably mounted on the motor. A hollow coolant reservoir is mounted within the interior of the hardhat.

There has thus been outlined, rather broadly, the more important features of the invention in order that the detailed description thereof that follows may be better understood and in order that the present contribution to the art may be better appreciated.

The invention may also include the bottom of the coolant reservoir comprising an atomizer. The power supply may be at least one of the group consisting of fuel cells, solar cells, batteries, and rechargeable batteries. A coolant may be enclosed by the coolant reservoir. The coolant may be water or alcohol. There may be a first switch wire connecting a switch to the power supply. There may be a second switch wire connecting the switch to the motor. The switch may be a rocker on/off switch or a pushbutton on/off switch. There may be a battery charger connected by a first charger wire and a second charger wire to the solar cell. A rechargeable battery may be enclosed by the battery charger. The battery charger may have an electrical port attached to its top. A charging cord may be removably connected to the electrical port. The fan and the coolant reservoir may be made of plastic, steel, aluminum, titanium, or carbon fiber composite. The invention may comprise an improvement to a hardhat. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air-conditioned hardhat that has all of the advantages of the prior art headgear and none of the disadvantages.

It is another object of the present invention to provide a new and improved air-conditioned hardhat that may be easily and efficiently manufactured and marketed.

An even further object of the present invention is to provide a new and improved air-conditioned hardhat that has a low cost of manufacture with regard to both materials and labor, and which accordingly is then susceptible of low prices of sale to the consuming public, thereby making such air-conditioned hardhat economically available to the buying public.

Still another object of the present invention is to provide a new air-conditioned hardhat that provides in the apparatuses and methods of the prior art some of the advantages thereof, while simultaneously overcoming some of the disadvantages normally associated therewith.

Even still another object of the present invention is to provide an air-conditioned hardhat for cooling the wearer's head. This allows the battery charger to be connected to an electrical outlet to charge the rechargeable battery.

Still yet another object of the present invention is to provide an air-conditioned hardhat for cooling the wearer's head. This makes it possible to charge the rechargeable battery using the solar cell.

An additional object of the present invention is to provide an air-conditioned hardhat for cooling the wearer's head. This allows the motor to be powered by the rechargeable battery or the solar cell.

A further object of the present invention is to provide an air-conditioned hardhat for cooling the wearer's head. This allows the wearer's head to be evaporatively cooled by the coolant.

A still further object of the present invention is to provide an air-conditioned hardhat for cooling the wearer's head. This permits the user to turn the motor on and off.

Yet another object of the present invention is to provide an air-conditioned hardhat for cooling the wearer's head. This allows the user to replenish the supply of coolant within the coolant reservoir.

Lastly, it is an object of the present invention to provide a new and improved air-conditioned hardhat for cooling the wearer's head.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 4:
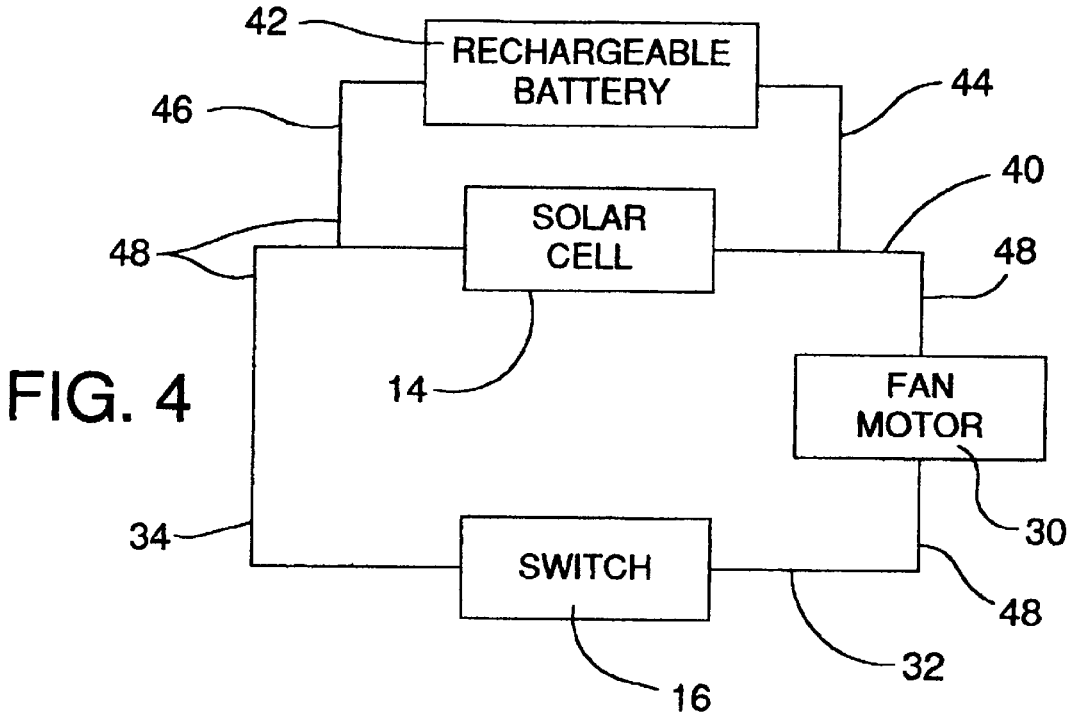
FIG. 4 is a block diagram view of the electrical system of the present invention.

Referring now to the drawings, and particularly to FIGS. 1–4, a current embodiment of the air-conditioned hardhat of the present invention is shown and generally designated by the reference numeral 10.

Figure 1:
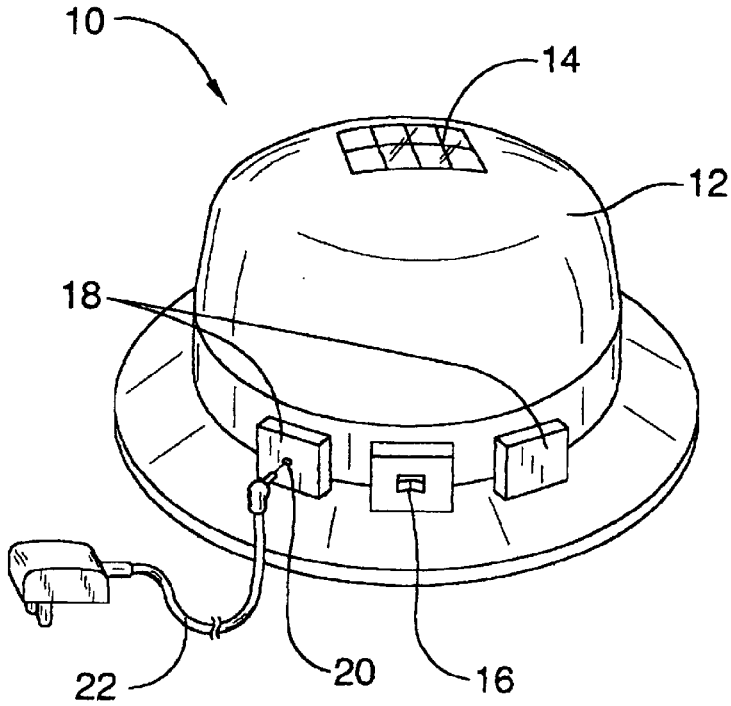
FIG. 1 is a top perspective view of the current embodiment of the air-conditioned hardhat constructed in accordance with the principles of the present invention.

In FIG. 1, a new and improved air-conditioned hardhat 10 of the present invention for cooling the wearer's head is illustrated and will be described. More particularly, the air-conditioned hardhat 10 has a hardhat 12 with a solar cell 14 attached to its top. A switch 16 and battery chargers 18 are attached to the side of the hardhat 12. One of the battery chargers 18 has an electrical port 20 in its top. One end of a charging cord 22 can be removably connected to the electrical port 20 to charge the rechargeable batteries 42 (not shown) enclosed by the battery chargers 18. The solar cell 14 can also be used to charge the rechargeable batteries 42. In the current embodiment, switch 16 is a rocker-type on/off switch and is used to determine whether or not motor 30 (not shown) is powered by the solar cell and/or the rechargeable batteries 42.

Figure 2:
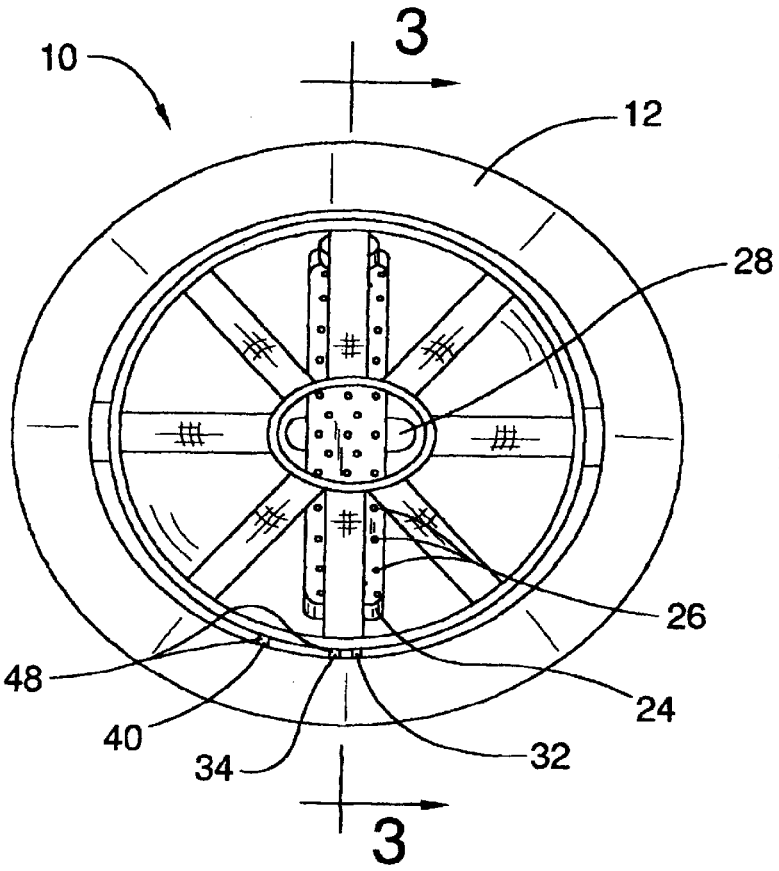
FIG. 2 is a bottom side view of the air-conditioned hardhat of the present invention.

Moving on to FIG. 2, a new and improved air-conditioned hardhat 10 of the present invention for cooling the wearer's head is illustrated and will be described. More particularly, the air-conditioned hardhat 10 has a hardhat 12. Fan 28 is visible behind the coolant reservoir 24 that is mounted in the top of the interior of the hardhat 12. The bottom of the coolant reservoir 24 is pierced by holes to comprise an atomizer 26. A motor wire 40, first switch wire 34, and second switch wire 32 of the electrical system 48 are shown. First switch wire 34 connects switch 16 (not shown) to the battery charger 18 (not shown) and rechargeable battery 42 (not shown). Second switch wire 32 connects switch 16 to the motor 30 (not shown). The motor wire 40 connects the motor to the battery charger 18 and rechargeable battery 42. The fan 28 blows air over the coolant reservoir 24. The moving air, combined with coolant 38 (not shown) emitted from the atomizer 26, enables evaporative cooling of the wearer's head (not shown). In the current embodiment, fan 28 and coolant reservoir 24 are made of plastic.

Figure 3:
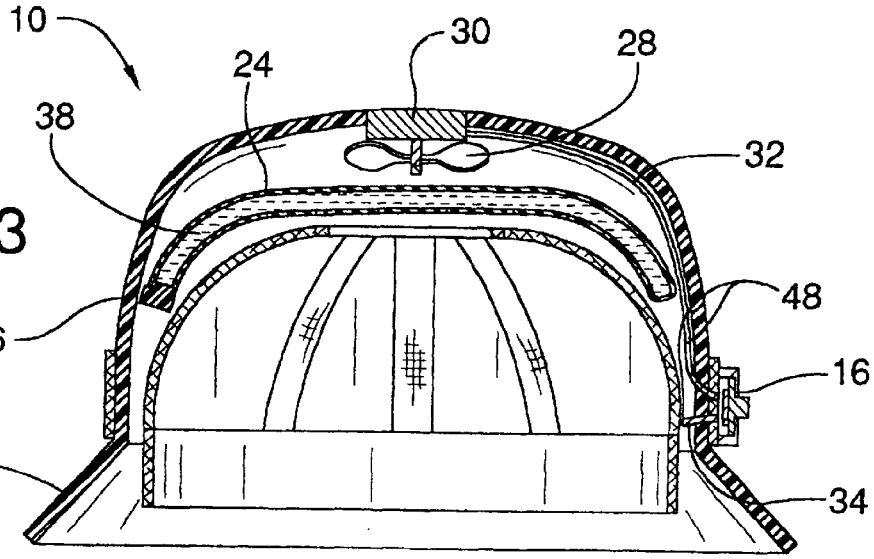
FIG. 3 is a side sectional view of the air-conditioned hardhat of the present invention.

Continuing with FIG. 3, a new and improved air-conditioned hardhat 10 of the present invention for cooling the wearer's head is illustrated and will be described. More particularly, the air-conditioned hardhat 10 has a hardhat 12 with a motor 30 attached to the top of its interior. Fan 28 is rotatably mounted on the bottom of motor 30. Coolant reservoir 24 encloses a coolant 38. A removably attached cap 36 closes off one end of the coolant reservoir 24. Cap 36 can be removed so that additional amounts of coolant 38 can be added to the coolant reservoir 24 as needed. In the current embodiment, coolant 38 is water. A second switch wire 32 connects the motor 30 to switch 16. A first switch wire 34 connects switch 16 to battery charger 18 (not shown). The position of switch 16 determines whether or not motor 30 is powered. When motor 30 is powered, fan 28 rotates, thereby blowing air over the coolant reservoir 24 and onto the wearer's head (not shown).

Concluding with FIG. 4, a new and improved electrical system 48 of the present invention for cooling the wearer's head is illustrated and will be described. More particularly, the electrical system 48 has a first switch wire 34, second switch wire 32, motor wire 40, first charger wire 44, and second charger wire 46. First switch wire 34 connects switch 16 to rechargeable battery 42. Second switch wire 32 connects switch 16 to motor 30. The motor wire 40 connects motor 32 rechargeable battery 42. The first charger wire 44 and the second charger wire 46 connect the rechargeable battery 42 to solar cell 14. The arrangement of the electrical system 48 allows the fan motor to be powered by the solar cell 14 and/or the rechargeable battery 42. Furthermore, the electrical system 48 also allows solar cell 14 to charge rechargeable battery 42 when sunlight is present and sufficient electrical current is being generated to meet the power needs of motor 40 if switch 16 is in the on position. If switch 16 is in the off position, then solar cell 14 charges rechargeable battery 42 with all of the electrical current it is generating.

In use, it can now be understood that the user optionally removably connects charging cord 22 to electrical port 20 and to an electrical outlet to charge rechargeable battery 42. Charging cord 22 is removed from electrical port 20 once the rechargeable battery 42 is fully charged. The user then removes the cap 36 and fills coolant reservoir 24 with a coolant 38. The user replaces cap 36 so that coolant 38 cannot flow out of coolant reservoir 24. The user places the air-conditioned hardhat 10 on his or her head. When the user feels uncomfortably hot, he or she flips switch 16 to the on position to power motor 30. The motor 30 rotates fan 28, thereby blowing air over the coolant reservoir 24 and onto the wearer's head. Coolant 38 escapes from coolant reservoir 24 through atomizer 26 and evaporatively cools the wearer's head. In the event sunlight is present, motor 30 is powered by solar cell 14. In the event more than sufficient electrical current is generated by solar cell 14 to drive motor 30, the additional electrical current is directed to battery charger 18 to charge rechargeable battery 42. In the event there is insufficient sunlight to drive motor 30, rechargeable battery 42 is discharged to drive motor 30. Once the wearer feels comfortable again, he or she flips switch 16 to its off position to stop motor 30. If sunlight is present, solar cell 14 continues to charge rechargeable battery 42 until rechargeable battery 42 is fully charged. When the initial quantity of coolant 38 within the coolant reservoir 24 is exhausted, the user can remove cap 36 to refill the coolant reservoir 24 with coolant 38.

While a current embodiment of the air-conditioned hardhat has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable lightweight material such as steel, aluminum, titanium, or carbon fiber composite may be used instead of the plastic fan and coolant reservoir described. Also, the coolant may also be alcohol. And although cooling the wearer's head has been described, it should be appreciated that the air-conditioned hardhat herein described could also be adapted for use as a firefighter helmet, an Army helmet, or a football helmet. Furthermore, a wide variety of power supplies may be used instead of the solar cell and rechargeable battery described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air-conditioned hardhat comprising:

a hardhat having a top, an exterior, and an interior;

a power supply attached to said exterior or said hardhat;

a motor wire having opposing ends with one end connected to said power supply;

a motor connected to said opposing end of said motor wire;

a fan rotatably mounted on said motor; and a hollow coolant reservoir having opposing ends and a bottom mounted within said interior of said hardhat;

wherein said bottom of said coolant reservoir comprises an atomizer.

2. In combination with a hardhat, including a top, an exterior, and an interior, the improvement which comprises:

a battery charger having a top attached to said exterior of said hardhat;

a solar cell attached to said top of said exterior of said hardhat;

a motor attached to said top of said interior of said hardhat;

a fan rotatably mounted on said motor;

a hollow coolant reservoir having a bottom and opposing ends mounted within said interior of said hardhat;

a cap removably attached to said end of said coolant reservoir;

a coolant enclosed by said coolant reservoir;

an atomizer wherein said bottom of said coolant reservoir defines a plurality of holes therein to comprise said atomizer;

a switch attached to said exterior of said hardhat;

a rechargeable battery enclosed by said battery charger;

a motor wire having opposing ends with one end connected to said battery charger and said opposing end connected to said motor;

a first charger wire having opposing ends with one end connected to said battery charger and said opposing end connected to said solar cell;

a second charger wire having opposing ends with one end connected to said battery charger and said opposing end connected to said solar cell;

a first switch wire having opposing ends with one end connected to said battery charger and said opposing end connected to said switch;

a second switch wire having opposing ends with one end connected to said switch and said opposing end connected to said motor;

an electrical port attached to said top of said battery charger; and a charging cord removably connected to said electrical port.

3. The improvement to a hardhat as defined in claim 2, wherein said switch is selected from the group consisting of rocker on/off switches and pushbutton on/off switches.

4. The improvement to a hardhat as defined in claim 2, wherein said coolant is selected from the group consisting of water and alcohol.

5. The improvement to a hardhat as defined in claim 2, wherein said fan and said coolant reservoir are selected from the group consisting of plastic, steel, aluminum, titanium, and carbon fiber composite.

* * * * *